US012752153B2

(12) United States Patent
Dobre

(10) Patent No.: US 12,752,153 B2
(45) Date of Patent: Oct. 6, 2026

(54) SPORTS LEG DRIVE TRAINING DEVICE

(71) Applicant: Michael Dobre, Easley, SC (US)

(72) Inventor: Michael Dobre, Easley, SC (US)

( * ) Notice: Subject to any disclaimer, the term of this patent is extended or adjusted under 35 U.S.C. 154(b) by 39 days.

(21) Appl. No.: 19/097,250

(22) Filed: Apr. 1, 2025

(65) Prior Publication Data

US 2025/0325866 A1 Oct. 23, 2025

Related U.S. Application Data

(60) Provisional application No. 63/635,905, filed on Apr. 18, 2024.

(51) Int. Cl.

| | |
|---|---|
| ***A63B 22/20*** | (2006.01) |
| ***A63B 21/00*** | (2006.01) |
| ***A63B 21/04*** | (2006.01) |
| ***A63B 22/00*** | (2006.01) |
| ***A63B 69/00*** | (2006.01) |
| ***A63B 102/18*** | (2015.01) |
| ***A63B 102/32*** | (2015.01) |

(52) U.S. Cl.

CPC ..... *A63B 22/203* (2013.01); *A63B 21/00061* (2013.01); *A63B 21/0428* (2013.01); *A63B 69/0002* (2013.01); *A63B 2022/003* (2013.01); *A63B 2022/0038* (2013.01); *A63B 2022/0092* (2013.01); *A63B 2069/0008* (2013.01); *A63B 2102/18* (2015.10); *A63B 2102/32* (2015.10)

(58) Field of Classification Search

CPC ..... A63B 21/00061; A63B 21/00065; A63B 21/023; A63B 21/0407; A63B 21/0428; A63B 21/0552; A63B 21/0557; A63B 21/4045; A63B 22/203; A63B 2022/003; A63B 2022/0038; A63B 2022/0092; A63B 23/04; A63B 69/0002; A63B 2069/0008; A63B 2102/18; A63B 2102/32

See application file for complete search history.

(56) References Cited

U.S. PATENT DOCUMENTS

| | | | | |
|---|---|---|---|---|
| 5,263,863 | A * | 11/1993 | Stefani | A63B 69/3673 473/272 |
| 5,318,290 | A | 6/1994 | Sawyer | |
| 6,749,529 | B1 | 6/2004 | Sobolewski | |
| 7,468,010 | B2 | 12/2008 | Du Brock | |
| 7,654,921 | B2 | 2/2010 | Brunst | |
| 8,221,271 | B1 * | 7/2012 | McIntyre | A63B 69/0002 473/272 |
| 8,303,439 | B2 | 11/2012 | Spallina | |
| 2006/0205528 | A1 * | 9/2006 | McMillan | A63B 69/3667 473/279 |
| 2007/0270251 | A1 | 11/2007 | Brunst | |

(Continued)

FOREIGN PATENT DOCUMENTS

| | | | | |
|---|---|---|---|---|
| DE | 20209758 | U1 * | 11/2002 | A63B 23/0488 |

*Primary Examiner* — Gary D Urbiel Goldner

(57) ABSTRACT

A sports leg drive training device trains proper leg drive while making a swinging motion. The device includes a base plate having a rear wall and a top surface. A track is on the top surface of the base plate and extends forwardly from the rear wall. A movable platform is slidably coupled to the track to move from a start position adjacent to the rear wall forwardly to an end position spaced farther away from the rear wall. The base plate is positionable on a ground surface in a static position while a drive leg of a sports player is positioned on the movable platform.

15 Claims, 6 Drawing Sheets

(56) References Cited

U.S. PATENT DOCUMENTS

| | | | | |
|---|---|---|---|---|
| 2011/0218059 | A1 | 9/2011 | Leone | |
| 2012/0065030 | A1* | 3/2012 | Sandvig | A63B 21/4015 482/79 |
| 2022/0105405 | A1 | 4/2022 | Baxter | |
| 2024/0216755 | A1* | 7/2024 | Van Der Hoeven | A63B 21/0552 |
| 2025/0177812 | A1* | 6/2025 | Trees | A63F 13/428 |

* cited by examiner

SPORTS LEG DRIVE TRAINING DEVICE

CROSS-REFERENCE TO RELATED APPLICATIONS

I hereby claim the benefit under 35 U.S.C. Section 119(e) of U.S. Provisional application 63/635,905 filed Apr. 18, 2024.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to sports swing training devices and more particularly pertains to a new leg drive training device for training proper leg drive and proper weight transfer while making a sports swinging motion such as swinging a baseball bat, golf club, or the like.

(2) Description of Related Art Including Information Disclosed Under 37 CFR 1.97 and 1.98

The prior art relates to sports swing training devices. Known sports swing training devices address arm position, smooth swinging motion, wrist turn, and other aspects of a sports swing but do not address the proper motion for leg drive in a sports related swing.

BRIEF SUMMARY OF THE INVENTION

An embodiment of the disclosure meets the needs presented above by generally comprising a base plate having a rear wall and a top surface. A track is on the top surface of the base plate and extends forwardly from the rear wall. A movable platform is slidably coupled to the track to move from a start position adjacent to the rear wall forwardly to an end position spaced farther away from the rear wall. The base plate is positionable on ground in a static position while a drive leg of a sports player is positioned on the movable platform.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
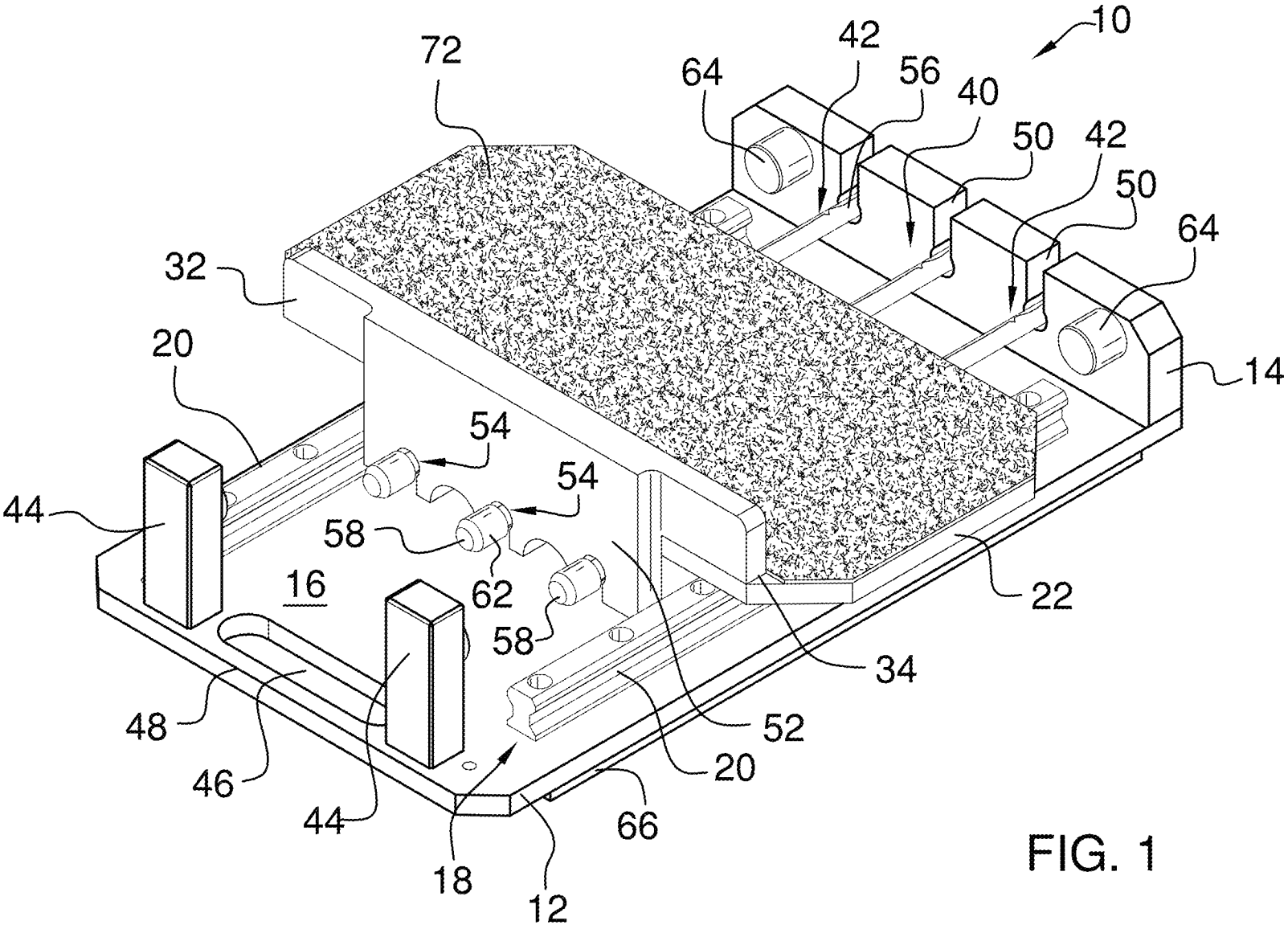
FIG. 1 is a top front side perspective view of a sports leg drive training device according to an embodiment of the disclosure.
Figure 2:
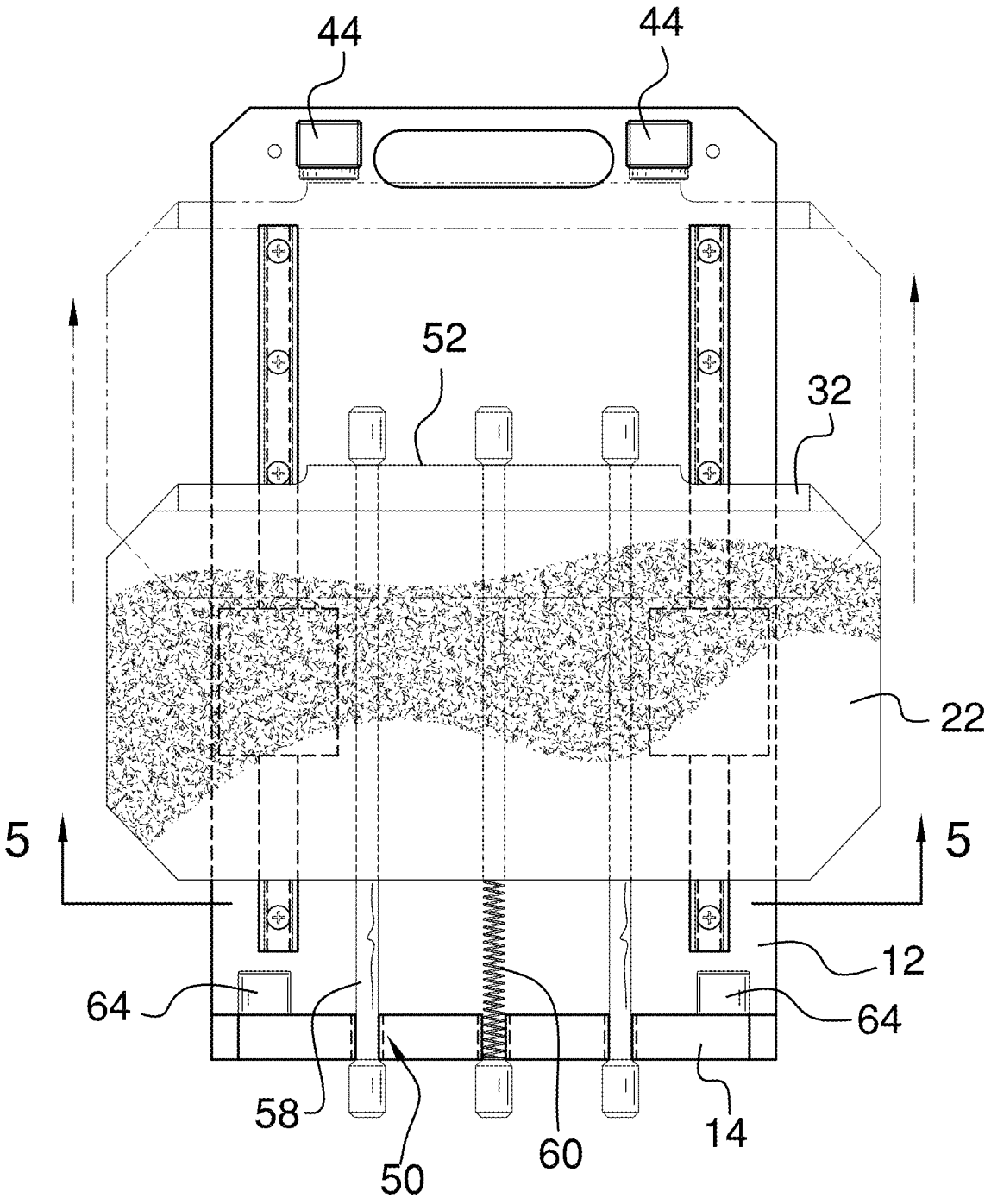
FIG. 2 is a top view of an embodiment of the disclosure.
Figure 3:
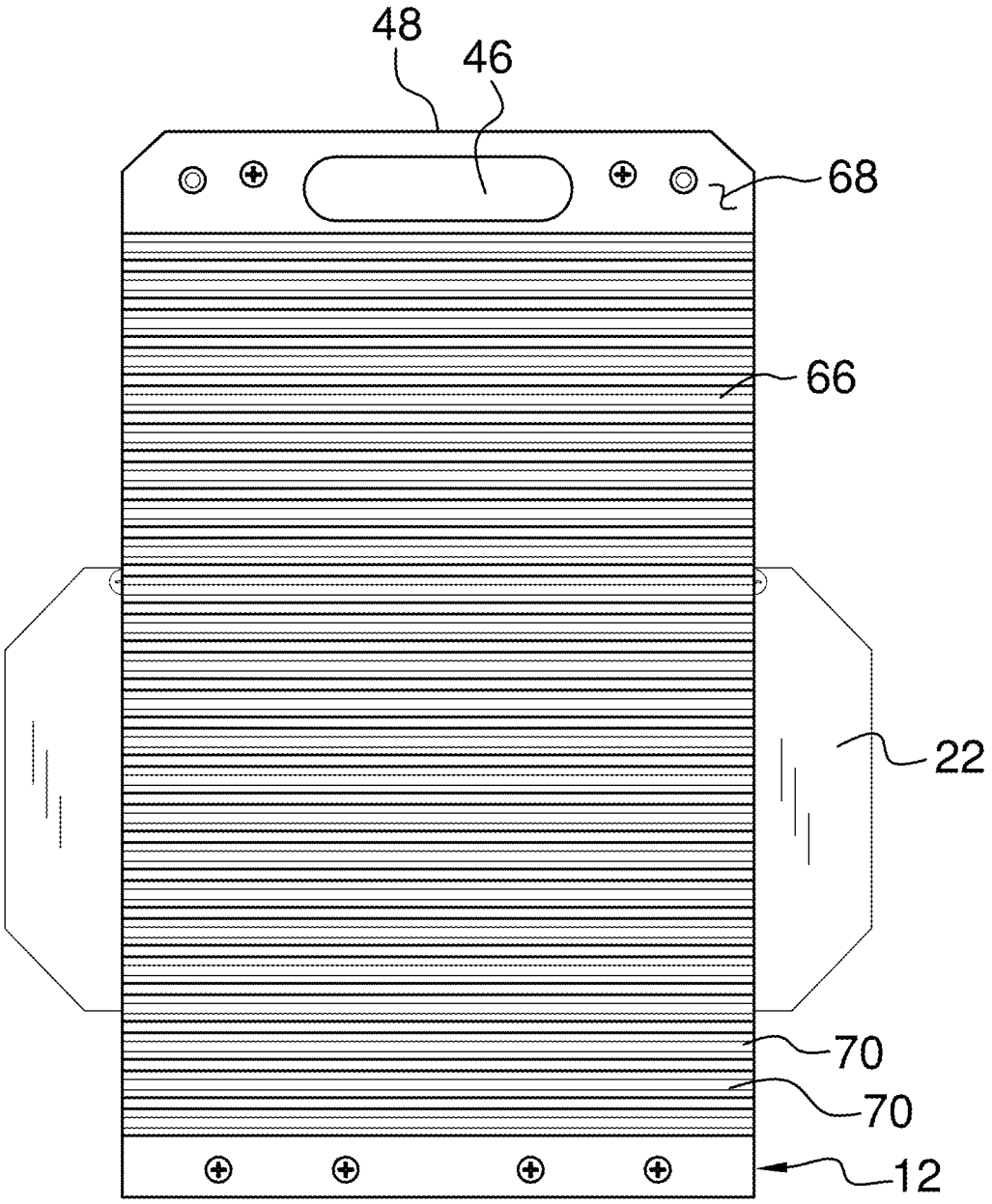
FIG. 3 is a bottom view of an embodiment of the disclosure.
Figure 4:
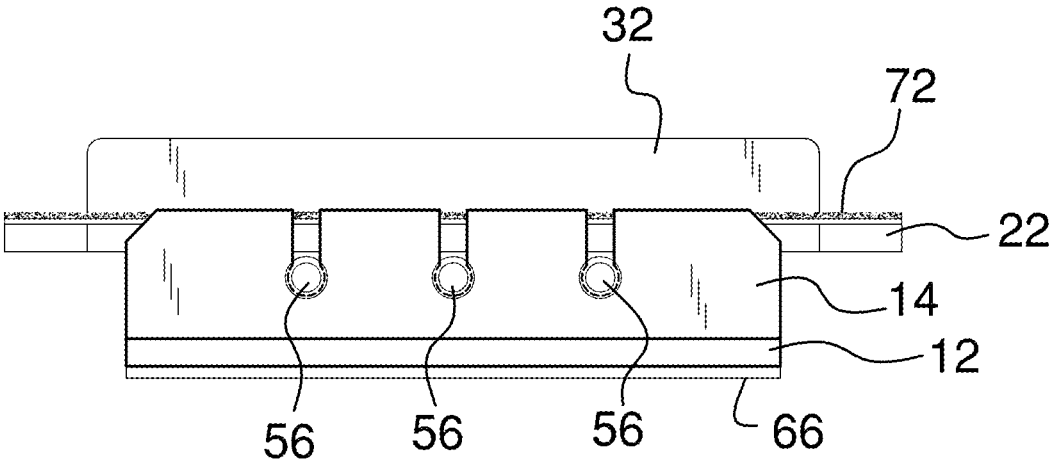
FIG. 4 is a back view of an embodiment of the disclosure.
Figure 5:
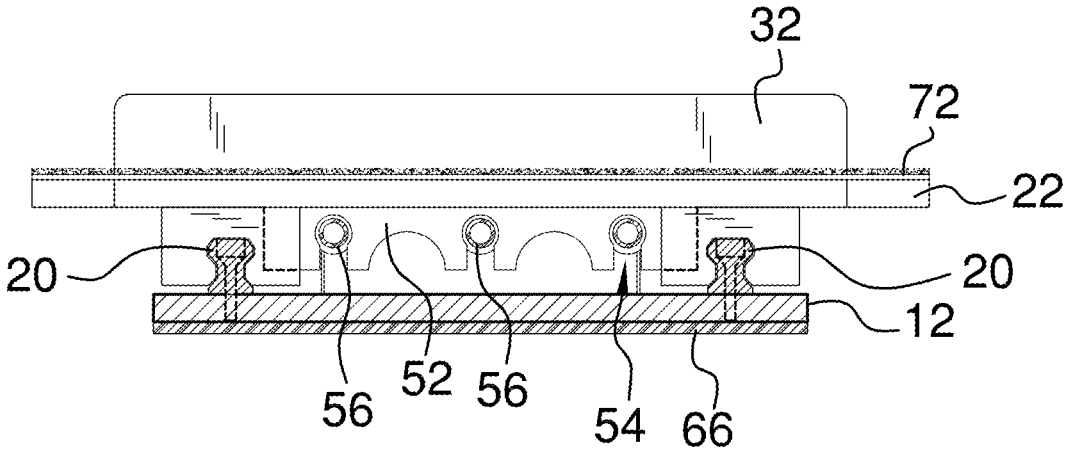
FIG. 5 is a cross-sectional view of an embodiment of the disclosure taken along line 5-5 in FIG. 2.
Figure 6:
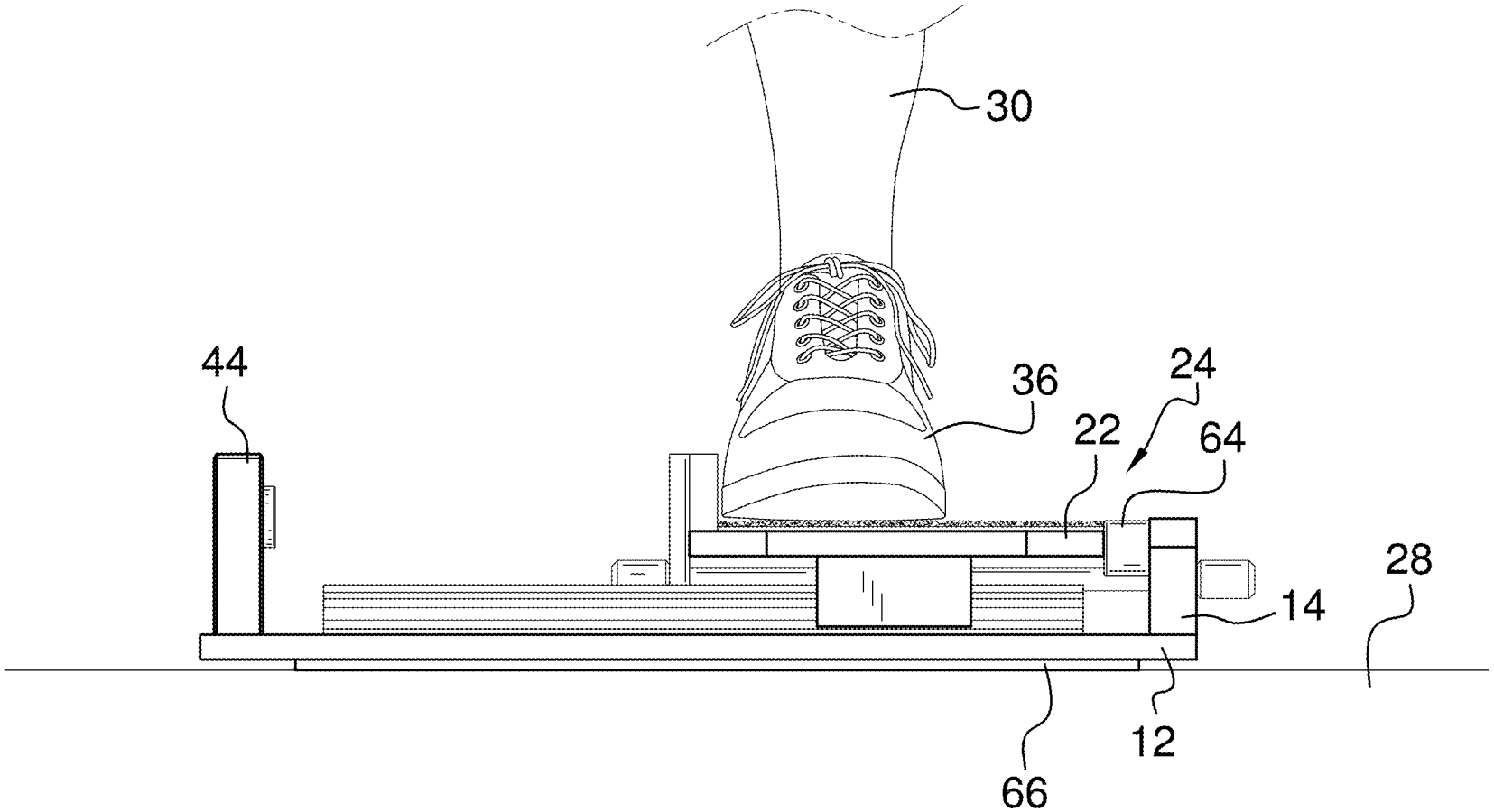
FIG. 6 is a side view of an embodiment of the disclosure in use.
Figure 7:
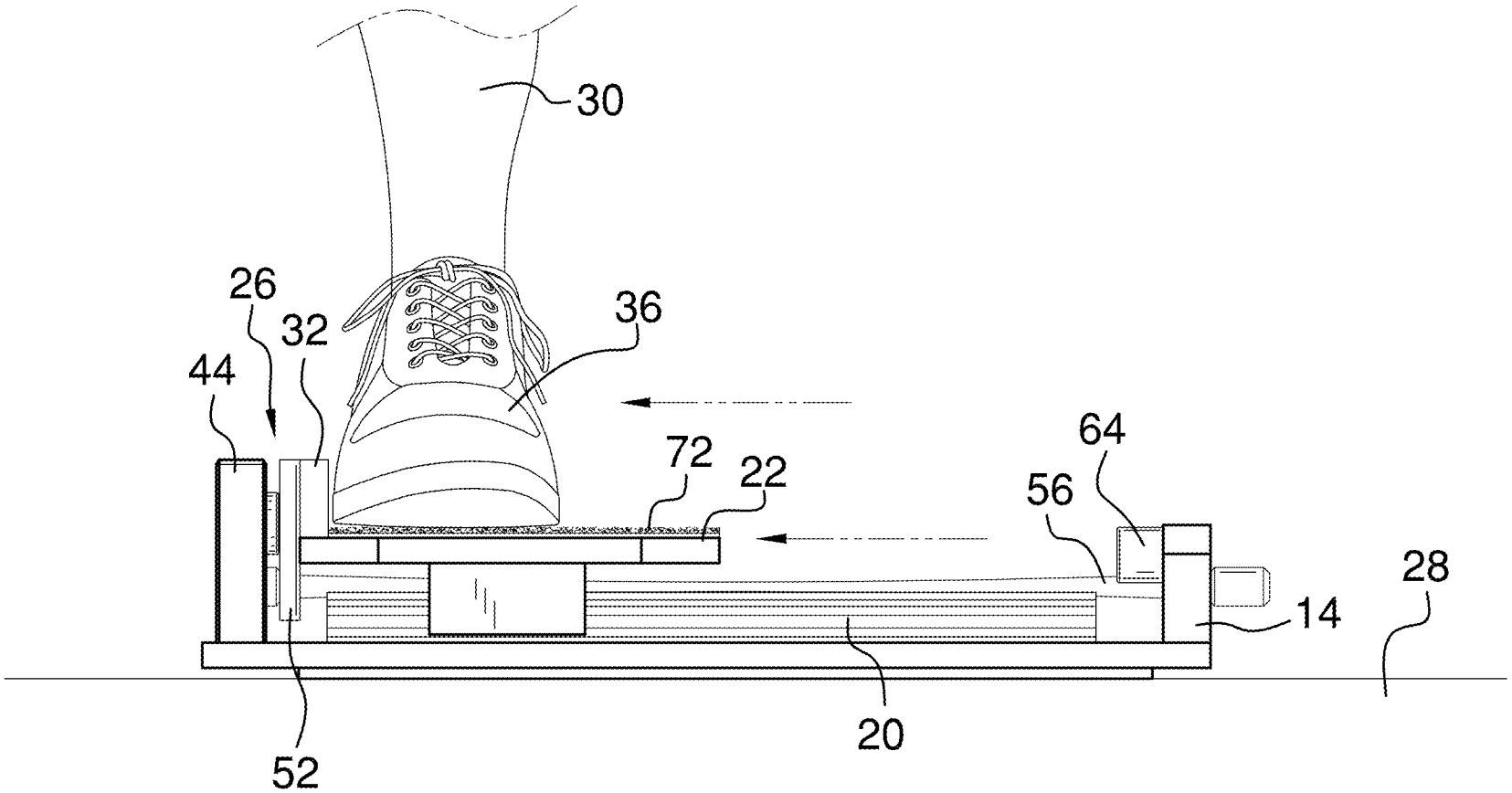
FIG. 7 is a side view of an embodiment of the disclosure in use.

With reference now to the drawings, and in particular to FIGS. 1 through 7 thereof, a new sports swing training device embodying the principles and concepts of an embodiment of the disclosure and generally designated by the reference numeral 10 will be described.

As best illustrated in FIGS. 1 through 7, the sports leg drive training device 10 generally comprises a base plate 12 having a rear wall 14 and a top surface 16. A track 18 is coupled to the top surface 16 of the base plate 12. The track 18 extends forwardly from the rear wall 14 of the base plate 12. The track 18 may be a pair of spaced parallel rails 20. A movable platform 22 is slidably coupled to the track 18 such that the movable platform 22 is positioned to move from a start position 24 adjacent to the rear wall 14 of the base plate 12 forwardly to an end position 26 spaced farther away from the rear wall 14 of the base plate 12. The base plate 12 is configured for positioning on ground 28 in a static position while a drive leg 30 of a sports player is positioned on the movable platform 22.

A brace wall 32 extends upwardly from an upper surface 34 of the movable platform 22 wherein the brace wall 32 is configured to abut a foot 36 of the drive leg 30 whereby the movable platform 22 is driven forwardly away from the rear wall 14 of the base plate 12 by movement of the drive leg 30 away from the rear wall 14 of the base plate 12. A resistance mechanism 40 is operationally coupled to the base plate 12 and the movable platform 22 such that the resistance mechanism 40 provides resistance to the movable platform 22 moving forwardly away from the rear wall 14 of the base plate 12. The resistance mechanism 40 is adjustable to vary resistance to forward movement of the movable platform 22 relative to the rear wall 14 of the base plate 12. The resistance mechanism 40 may include a set of interchangeable resistance members 42 for varying resistance to movement of the movable platform 22 away from the rear wall 14 of the base plate 12. Multiple sets of the interchangeable resistance members 42 can be provided with each set of interchangeable resistance members 42 including multiple resistance members 42. Each set may be characterized by uniform resistance between the interchangeable resistance members 42 with a degree of resistance being indicated through numbering, color coding, or the like. However, as will become apparent, the interchangeable resistance members 42 being interchangeable will allow for various permutations and combinations for a high degree of customization of a total amount of resistance between the movable platform 22 and the rear wall 14 of the base plate 12. Resistance to movement of the movable platform 22 away from the rear wall 14 of the base plate 12 may also be adjustable by changing a number of resistance members 42 coupled to the base plate 12 and the movable platform 22.

Each of a pair of stops 44 is coupled to the base plate 12. Each stop 44 of the pair of stops 44 extends upwardly from the top surface 16 of the base plate 12. Each stop 44 of the pair of stops 44 is positioned opposite the rear wall 14 such that the track 18 extends from the rear wall 14 towards the stop 44. Each stop 44 of the pair of stops 44 is positioned to obstruct and limit movement of the movable platform 22 on the track 18.

An aperture 46 extends through the base plate 12 to define a handle 48 for facilitating lifting and carrying the base plate 12 and thus, the whole device 10. The aperture 46 is positioned between the pair of stops 44 and may be elongated and rectangular, oval or otherwise shaped to facilitate grasping the base plate 12.

The resistance mechanism 40 may more specifically include a plurality of slots 50 extending into the rear wall 14 of the base plate 12 and a resistance plate 52 being coupled to the movable platform 22. The resistance plate 52 has a plurality of notches 54. Each notch 54 is linearly aligned with a respective one of the slots 50. The resistance plate 52 extends downwardly relative to the movable platform 22 and forwardly from the movable plate 22. The resistance plate 52 further has a width greater than a distance between the pair of stops 44 such that the resistance plate 52 abuts the pair of stops 44 to limit forward movement of the movable platform 22, The interchangeable resistance members 42 are a plurality of resiliently extendable linear members 56 such as a resistance band 58, spring 60, or the like. Each of the resiliently extendable linear members 56 is insertable into an associated one of the slots 50 in the rear wall 14 and an associated one of the notches 54 in the resistance plate 52. Each resiliently extendable linear member 56 may have a length and bulbous ends 60 either integrally or by attachment of a collar 62 sized larger than respective widths of the slots 50 and notches 54 whereby the resiliently extendable linear member 56 is secured between the rear wall 14 of the base plate 12 and the resistance plate 52 such that the resiliently extendable linear member 56 is stretched to urge the movable platform 22 towards the rear wall 14 into the start position 24. Each of a plurality of rear wall stoppers 64 may be coupled to the rear wall 14 of the base plate 12. The movable platform 22 abuts the rear wall stoppers 64 when the movable platform is in the start position 24.

To enhance static positioning of the base plate 12 on the ground 28 a base mat 66 may be coupled to and cover a lower surface 68 of the base plate 12. The base mat 66 has a plurality of ridges 70. The ridges 70 are parallel to each other and perpendicular to the track 18 wherein the base mat 66 is configured to resist movement of the base plate 12 on the ground 28. A cover layer 72 may be coupled to and cover the top surface 16 of the base plate 12 extending forwardly from the rear wall 14 of the base plate 12. The cover layer 72 may be an artificial turf or the like to inhibit slippage of the foot 36 of the drive leg 30 on the movable platform 22.

In use, the base plate 12 is positioned in a desired location which may for example be relative to a home plate such that a user is positioned correctly for swinging a bat at a pitched baseball. It is contemplated that the device 10 may be used for other sports as discussed above. As the user swings the bat the drive leg 30 is moved abutting the brace wall 32 to move the movable platform 22 forward away from the rear wall 14 of the base plate 12. The resistance mechanism 40 provides physical feedback felt through the drive leg 30 to train the user to properly drive the drive leg 30 forwardly during the swing. The stops 44 limit motion of the movable platform 22 to train against excessive forward movement of the drive leg 30 during the swing.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sports leg drive training device comprising:

a base plate having a rear wall and a top surface;

a track coupled to said top surface of said base plate, said track extending forwardly from said rear wall of said base plate;

a movable platform, said movable platform being slidably coupled to said track wherein said movable platform is positioned to move from a start position adjacent to said rear wall of said base plate forwardly to an end position spaced farther away from said rear wall of said base plate;

a pair of stops coupled to said base plate, each stop of said pair of stops extending upwardly from said top surface of said base plate, each stop of said pair of stops being positioned opposite said rear wall such that said track extends from said rear wall towards said stop, each stop of said pair of stops being positioned to obstruct and limit movement of said movable platform on said track; and an aperture extending through said base plate to define a handle for facilitating lifting and carrying said base plate, said aperture being positioned between said pair of stops;

wherein said base plate is configured for positioning on a ground surface in a static position while a drive leg of a sports player is positioned on said movable platform.

2. The sports leg drive training device of claim 1 further comprising a brace wall extending upwardly from an upper surface of said movable platform wherein said brace wall is configured to abut a foot of the drive leg whereby the movable platform is driven forwardly away from said rear wall of said base plate by movement of the drive leg away from said rear wall of said base plate.

3. The sports leg drive training device of claim 1, further comprising a resistance mechanism operationally coupled to said base plate and said movable platform wherein said resistance mechanism provides resistance to said movable platform moving forwardly away from said rear wall of said base plate.

4. The sports leg drive training device of claim 3, further comprising said resistance mechanism comprising at least one of resistance bands and springs.

5. The sports leg drive training device of claim 4, further comprising said resistance mechanism comprising a set of interchangeable resistance members for varying resistance to movement of said movable platform away from said rear wall of said base plate.

6. The sports leg drive training device of claim 4, wherein resistance to movement of said movable platform away from said base plate is adjustable by changing a number of said at least one of resistance bands and springs coupled to said base plate and said movable platform.

7. The sports leg drive training device of claim 3, further comprising said resistance mechanism being adjustable to vary resistance to forward movement of said movable platform relative to said rear wall of said base plate.

8. The sports leg drive training device of claim 3, wherein said resistance mechanism comprises:

a plurality of slots extending into said rear wall of said base plate;

a resistance plate coupled to said movable platform, said resistance plate having a plurality of notches; and a plurality of resiliently extendable linear members, each of said plurality of resiliently extendable linear members being insertable into an associated one of said plurality of slots in said rear wall and an associated one of said plurality of notches in said resistance plate whereby each of said plurality of resiliently extendable linear members is secured between said rear wall of said base plate and said resistance plate such that each of said plurality of resiliently extendable linear members is stretched to urge said movable platform towards said rear wall.

9. The sports leg drive training device of claim 8, wherein each of said plurality of resiliently extendable linear members is one of a resistance band and a spring.

10. The sports leg drive training device of claim 3, wherein said resistance mechanism comprises:

a resistance plate coupled to said movable platform; and a resiliently extendable linear member, said resistance plate being coupled to said rear wall by said resiliently extendable linear member.

11. The sports leg drive training device of claim 10, further comprising said resistance plate extending forwardly from said movable plate, said resistance plate having a width greater than a distance between said pair of stops such that said resistance plate abuts said pair of stops to limit forward movement of said movable platform.

12. The sports leg drive training device of claim 1, further comprising a plurality of rear wall stoppers, each rear wall stopper being coupled to said rear wall of said base plate, said movable platform abutting said plurality of rear wall stoppers when said movable platform is in said start position.

13. The sports leg drive training device of claim 1, further comprising a base mat coupled to and covering a lower surface of said base plate, said base mat having a plurality of ridges, said plurality of ridges being parallel to each other and perpendicular to said track wherein said base mat is configured to resist movement of said base plate on the ground surface.

14. The sports leg drive training device of claim 1, further comprising a cover layer coupled to and covering said top surface of said base plate extending forwardly from said rear wall of said base plate.

15. A sports leg drive training device comprising:

a base plate having a rear wall and a top surface;

a track coupled to said top surface of said base plate, said track extending forwardly from said rear wall of said base plate;

a movable platform, said movable platform being slidably coupled to said track wherein said movable platform is positioned to move from a start position adjacent to said rear wall of said base plate forwardly to an end position spaced farther away from said rear wall of said base plate, wherein said base plate is configured for positioning on a ground surface in a static position while a drive leg of a sports player is positioned on said movable platform;

a brace wall extending upwardly from an upper surface of said movable platform wherein said brace wall is configured to abut a foot of the drive leg whereby the movable platform is driven forwardly away from said rear wall of said base plate by movement of the drive leg away from said rear wall of said base plate;

a resistance mechanism operationally coupled to said base plate and said movable platform wherein said resistance mechanism provides resistance to said movable platform moving forwardly away from said rear wall of said base plate, said resistance mechanism being adjustable to vary resistance to forward movement of said movable platform relative to said rear wall of said base plate, said resistance mechanism comprising a set of interchangeable resistance members for varying resistance to movement of said movable platform away from said rear wall of said base plate, said set of interchangeable resistance members including multiple resistance members wherein resistance to movement of said movable platform away from said base plate is adjustable by changing a number of said multiple resistance members coupled to said base plate and said movable platform;

a pair of stops coupled to said base plate, each stop of said pair of stops extending upwardly from said top surface of said base plate, each stop of said pair of stops being positioned opposite said rear wall such that said track extends from said rear wall towards said stop, each stop of said pair of stops being positioned to obstruct and limit movement of said movable platform on said track;

an aperture extending through said base plate to define a handle for facilitating lifting and carrying said base plate, said aperture being positioned between said pair of stops;

wherein said resistance mechanism further includes:

a plurality of slots extending into said rear wall of said base plate, a resistance plate coupled to said movable platform, said resistance plate having a plurality of notches, said resistance plate extending forwardly from said movable plate, said resistance plate having a width greater than a distance between said pair of stops such that said resistance plate abuts said pair of stops to limit forward movement of said movable platform, and said multiple resistance members being a plurality of resiliently extendable linear members, each of said plurality of resiliently extendable linear members being insertable into an associated one of said plurality of slots in said rear wall and an associated one of said plurality of notches in said resistance plate whereby each of said plurality of resiliently extendable linear members is secured between said rear wall of said base plate and said resistance plate such that each of said plurality of resiliently extendable linear members is stretched to urge said movable platform towards said rear wall, wherein each of said plurality of resiliently extendable linear members is one of a resistance band and a spring;

a plurality of rear wall stoppers, each rear wall stopper being coupled to said rear wall of said base plate, said movable platform abutting said plurality of rear wall stoppers when said movable platform is in said start position;

a base mat coupled to and covering a lower surface of said base plate, said base mat having a plurality of ridges, said plurality of ridges being parallel to each other and perpendicular to said track wherein said base mat is configured to resist movement of said base plate on the ground surface; and a cover layer coupled to and covering said top surface of said base plate extending forwardly from said rear wall of said base plate.

* * * * *